US005491854A

United States Patent [19]

Music

[11] Patent Number: 5,491,854

[45] Date of Patent: Feb. 20, 1996

[54] INFLATABLE MATTRESS AND BED ASSEMBLY WITH TAUT, TENSIONED COVER

[76] Inventor: Earl D. Music, 2570 N. Interstate, Norman, Okla. 73072

[21] Appl. No.: 246,171

[22] Filed: May 19, 1994

[51] Int. Cl.[6] ..... A61G 7/057; A61G 7/05; A47G 9/04

[52] U.S. Cl. ..... 5/618; 5/470; 5/496; 5/498; 24/72.5

[58] Field of Search ..... 5/449–458, 470, 5/471, 484, 495–502, 613–619; 24/72.5

[56] References Cited

U.S. PATENT DOCUMENTS

| | | | |
|---|---|---|---|
| 505,649 | 9/1893 | Chaney | 5/499 |
| 1,700,535 | 1/1929 | Kaufmann . | |
| 1,722,429 | 7/1929 | Kaufmann | 5/484 |
| 1,841,410 | 1/1932 | Karr . | |
| 1,892,841 | 1/1933 | Kaufmann | 5/498 |
| 2,291,444 | 7/1942 | Bengtson | 5/320 |
| 2,446,362 | 8/1948 | Curtis | 5/498 |
| 2,923,014 | 2/1960 | Hume . | |
| 2,931,084 | 4/1960 | DeWitt | 5/484 |
| 4,336,621 | 6/1982 | Schwartz et al. | 5/496 |
| 4,662,016 | 5/1987 | Seeman | 5/508 |
| 4,937,904 | 7/1990 | Ross | 5/497 |

OTHER PUBLICATIONS

"Deluxe Air Bed" A Brochure Available from Texport 1332 Conrad Sauer, Houston, Texas 77043.

*Primary Examiner*—Alexander Grosz
*Attorney, Agent, or Firm*—Dougherty, Hessin, Beavers & Gilbert

[57] ABSTRACT

A bed assembly for preventing the occurrence of bed sores on long term patients includes a bed frame which has a structural perimeter framework. An inflatable mattress has a bottom supported on the bed frame. The mattress has a top and a mattress periphery surrounding the top. A covering overlies the top of the inflatable mattress. The covering has a covering periphery. A plurality of tensioning devices are placed about the covering periphery and connected between the covering and the structural perimeter framework for holding the covering taut and smooth over the top of the inflatable mattress, and for holding down the mattress and preventing the mattress periphery from bending upwardly when a patient lies on the inflatable mattress.

34 Claims, 2 Drawing Sheets

INFLATABLE MATTRESS AND BED ASSEMBLY WITH TAUT, TENSIONED COVER

BACKGROUND OF THE INVENTION

1. Field of the Invention.

The present invention relates generally to the construction of an inflatable mattress assembly, and more particularly, but not by way of limitation, to such an assembly which is especially constructed for use by long term invalid patients.

2. Description of the Prior Art.

One problem which has always been faced by the health care industry is the difficulty of providing adequate bedding for long term patients, many of which may lie in bed for years and be unable to move themselves. One serious health problem encountered by these patients, which is a result merely of the fact that they must remain in bed for extended times, is the creation of bed sores on the patient's skin due to irritation from the bed. Another problem which is encountered by the care giver, such as a nurse, is the difficulty of moving such patients, e.g., to roll them over on the bed.

Many different approaches have been tried to alleviate the problem of bed sores in long term patients. Typically the purpose of special mattresses which have been developed to date has been to provide circulation of air under the patient.

One such approach has been to construct the mattress of foam rubber with many cavities placed in it. This provides a very soft mattress. In addition to the fact that such mattresses fail to adequately prevent the creation of bed sores, these mattresses in fact aggravate the practical problem of the care giver being able to roll the patient over on the mattress. With such a soft mattress, the patient sinks down into the mattress and literally must be raised out of a hole to be moved upon the mattress.

Another approach has involved the use of air mattresses having a foraminous or perforated upper surface through which air is allowed to bleed out of the mattress across the top surface of the mattress. Such mattresses have proven to have a very short service life and they still do not adequately prevent the creation of bed sores.

Neither of these approaches has been successful enough to achieve widespread use by hospitals and other health care institutions. Long term patients are typically placed upon conventional mattresses. The problem of moving such patients on the mattress is typically addressed through the use of a "draw sheet". A draw sheet is simply a folded up bed sheet which lies under the upper torso of the patient and extends laterally across the mattress. When it is desired to roll the patient over or move the patient from the hospital bed to a litter, the draw sheet is looped over the top of the patient and the patient is literally dragged across the top of the mattress onto the litter. Similar techniques are used merely to turn the patient over in the bed, particularly if the patient is a large individual.

With the ever increasing population of bed ridden patients, and with medical advances which make it possible to maintain the lives of these patients far longer than has been possible in the past, the problem of bed sores for long term bed ridden patients becomes an ever more acute one.

There is truly a long felt need in the industry, and by society in general, for an effective and economical solution to this problem.

SUMMARY OF THE INVENTION

Through long term experimentation with my own adult son who has been bed ridden for over five years and who my wife and I care for in our home, I have developed a bed and mattress assembly which substantially eliminates the problem of bed sores and which also makes it extremely easy to roll the patient from side to side on the bed. Additionally, the bed and mattress assembly is relatively economical to construct and is easy to assemble and use.

The mattress assembly has been especially developed for use on an articulated bed frame, but it also may be used on an conventional fixed bed frame.

In its simplest form, my bed assembly includes a bed frame having a structural perimeter frame work. An inflatable mattress lies on top of the bed frame. A covering overlies the top of the inflatable mattress. A plurality of tensioning devices are placed about the periphery of the covering and are connected between the covering and the structural perimeter framework of the bed frame. The tensioning devices hold the covering taut and smooth over the top of the inflatable mattress. Also, the tensioning devices hold down the mattress and prevent the outer periphery of the mattress from bending upwardly when the patient lies on the inflatable mattress.

When used upon an articulated bed frame, the plurality of tensioning devices will hold the covering smooth and taut over the top of the inflatable mattress in multiple articulated position of the articulated bed frame.

This combination of components provides several significant advantages.

First, the covering serves as the undersheet for the patient and provides a firm smooth wrinkle free surface upon which the patient can lie. I have determined that the most important goal in preventing bed sores is to eliminate sources of irritation such as wrinkled sheets and the like which are presented by conventional beds. Thus, with the patient laying upon the smooth wrinkle free surface these sources of irritation are eliminated and if the patient is properly cared for bed sores are eliminated.

A second unique advantage of the combination is that by providing a very firm supporting surface for the patient, it is much easier for a care giver to roll the patient over on the mattress. By improving the ease with which the care giver can move the patient upon the mattress, it becomes much more likely that the patient will be periodically moved by the care giver. This also greatly reduces the incidents of bed sores, since bed sores typically result from the patient lying in one position for long periods of time upon an irritating surface.

Another very distinct advantage which is provided by the bed assembly described above is that relatively inexpensive inflatable air mattresses can be utilized and will last for many months if they are properly used in combination with the covering and plurality of tensioning means described above. On the other hand, a simple air mattress used alone will last only a few weeks.

Still another advantage of the present invention as contrasted to the use of a simple inflatable air bed without the covering and tensioning means of the present invention is that the patient can be placed upon the bed and the covering and tensioning means will hold down the periphery of the bed so it does not flip up thus leaving the patient lying in a depression in the mattress. The covering means and resilient tensioning devices included in the present invention will hold the outer periphery of the mattress fixed in place regardless of the load placed on the mattress.

Thus it is a general object of the present invention to provide an improved bed assembly which is suitable for long term care patients and which will prevent the creation of bed sores on such patients.

It is another object of the present invention to provide an improved bed assembly upon which a patient may be easily moved by a care giver.

Still another object of the present invention is the construction of a bed assembly which is economical to build and install and is easy to use by the care giver.

Numerous other objects,features and advantages of the present invention will be readily apparent to those skilled in the art upon a reading of the following disclosure when taken in conjunction with the accompanying drawings.

BRIEF DESCRIPTION OF THE DRAWINGS

In FIG. 1 the mattress is shown in a standard horizontal position.

DETAILED DESCRIPTION OF THE PREFERRED EMBODIMENTS

Figure 1:
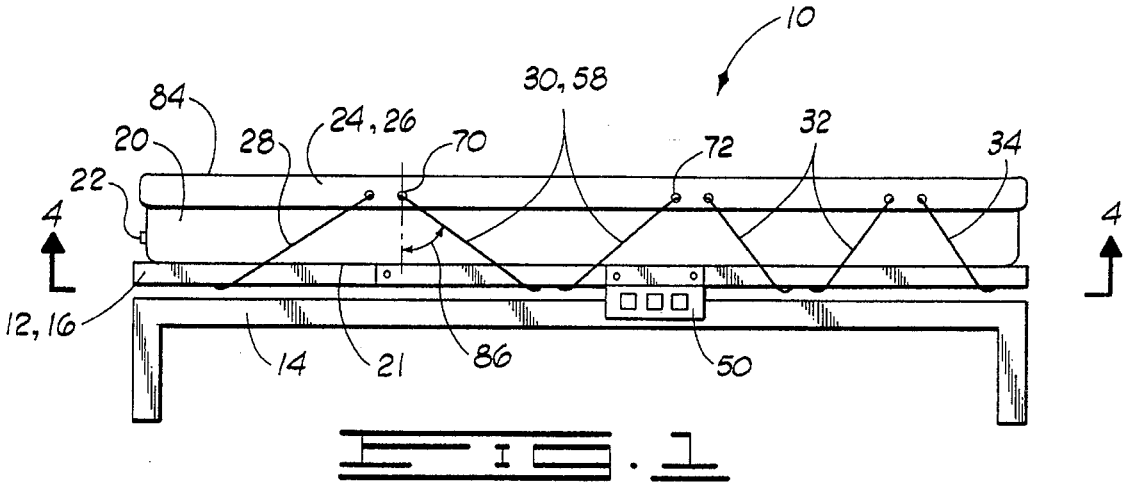
FIG. 1 is a schematic side elevation view of an articulated hospital bed incorporating the bed assembly of the present invention.
Figure 2:
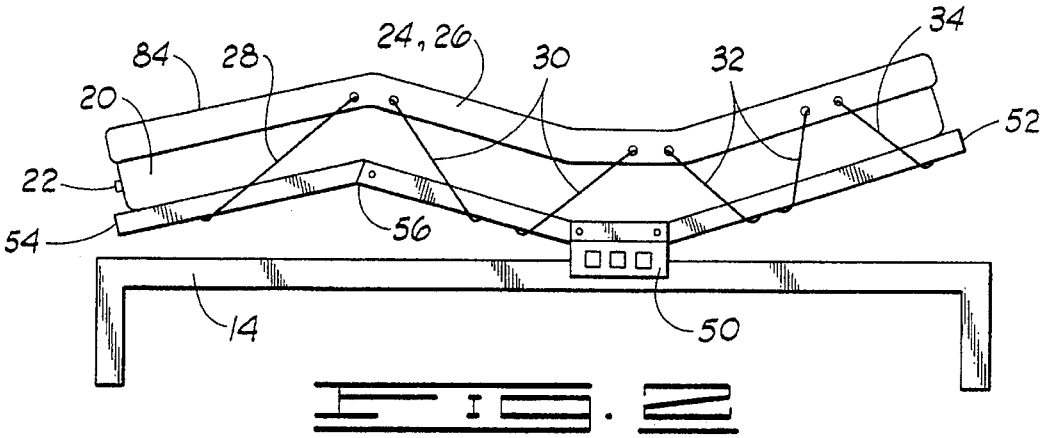
FIG. 2 illustrates a typical articulated position of the bed frame wherein the head of the bed has been raised and wherein an intermediate portion of the bed below the patient's knees has been raised.
Figure 3:
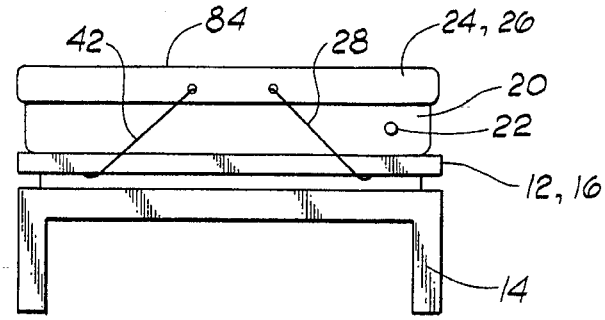
FIG. 3 is an end elevation view of the foot of the bed of FIG. 1 as viewed from the left in FIG. 1.
Figure 4:
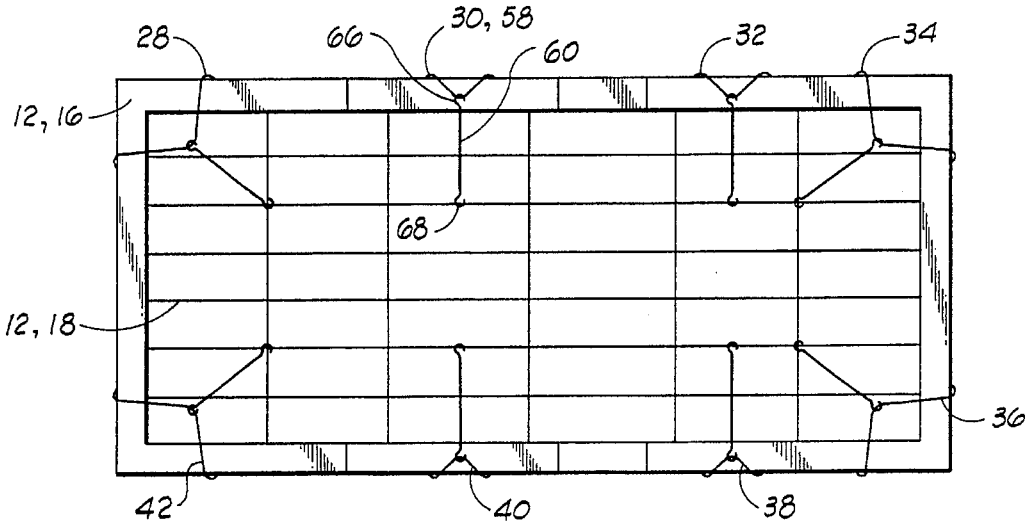
FIG. 4 is a bottom view of the bed frame of the bed assembly of FIG. 1, taken along line 4–4 of FIG. 1.

Turning now to the drawings and particularly to FIG. 1 the bed assembly of the present invention is generally designated by the numeral 10. The bed assembly 10 includes a bed frame 12 supported from a base 14. The bed frame 12 is an articulated bed frame. Bed frame 12 includes an outer structural perimeter framework 16. As best seen in FIG. 4, the bed frame 12 has a bed spring assembly 18 which is stretched across the structural perimeter framework 16.

An inflatable mattress 20 has a bottom 21 supported on the bed frame 12, it has a top and it has four sides defining the periphery of the mattress. A cloth quilt or other protective padding may be placed between the bed spring assembly 18 and inflatable mattress 20 to prevent damage to mattress 20 from sharp edges of the bed spring assembly 18. The mattress 20 is preferably a heavy duty air bed having a vertical thickness of approximately 8 inches, such as the "Deluxe Air Bed" available from Texsport, 1332 Conrad Sauer, Houston, Tex. 77043. These inflatable air beds are not commonly sold for hospital use but instead are intended for temporary short term use by hunters, outdoorsmen, and the like.

The inflatable mattress 20 is inflated with air introduced into an inflation valve 22.

A covering 24 overlies the top of the inflatable mattress and has a covering periphery 26. A fitted sheet may be placed between mattress 20 and covering 24 for aesthetic purposes. The air mattress 20 has a plurality of indentations in its upper surface which aid in allowing the covering 24 to breathe. The covering 24 may either be constructed separate from the inflatable mattress 20 or the covering may be integrally attached to the inflatable mattress 20.

The covering 24 is preferably constructed of a relatively nonstretchable very breathable fabric. One fabric that I have found to be satisfactory includes a heavy velour fabric.

The covering 24 preferably is constructed as an under sheet and is adapted and constructed so the patient may lie directly on the covering.

A plurality of tensioning means such as tensioning means 28, 30, 32, 34, 36, 38, 40 and 42 are placed about the covering periphery 26 and connected between the covering 24 and the structural perimeter framework 12 for holding the covering 24 taut and smooth over the top of the inflatable mattress 20, and for holding down the inflatable mattress 20 and preventing the mattress periphery from bending upwardly when a patient lies on the inflatable mattress.

As is apparent in the drawings, the mattress 24 is generally rectangular having four sides, and the plurality of tensioning devices 28 through 42 are placed about all four sides of the mattress periphery.

The plurality of tensioning devices 28 through 42 can be described as a plurality of resilient tensioning means placed about the covering 24 and attached between the covering 24 and the articulated bed frame 12 for tensioning the cover 24 in all directions in the plane of the covering and for holding the covering 24 taut and smooth over the inflatable mattress 20 in multiple articulated positions of the articulated bed frame 12, so that the creation of bed sores on patients due to irritation from wrinkled coverings is eliminated. The plurality of resilient tensioning devices 28 through 42 may also be described as a means for holding down the mattress 20 and preventing the mattress from bending upwardly when a patient lies on the mattress 20 and thereby aiding in mobility of a patient upon the mattress 20 by a care giver.

Figure 8:
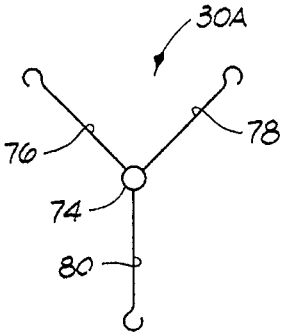
FIG. 8 is a schematic illustration of a prior art inflatable air mattress showing the manner in which the outer periphery of the mattress will bend upward when a load is placed in the center of the mattress.

FIG. 8 is a schematic illustration of the inflatable mattress 20, which taken alone is part of the prior art, showing how the outer periphery 44 of the mattress bends upwardly away from a supporting surface 46 when a load 48 such as patient is placed in the center of the mattress in the absence of the covering and tensioning means of the present invention.

The bed frame 12 and base 14 are themselves a part of the prior art and comprise a conventional articulated bed frame assembly. The articulate bed frame 12 is supported from the base 14 by a plurality of adjustable supports which are typically electrically powered. The position of the articulated bed frame 12 relative to the base 14 is controlled from a control panel 50. Through the controls on the control panel 50, the head 52 and foot 54 of the bed frame 12 may be raised and lowered as desired, and an intermediate portion 56 of the bed frame located generally below the patient's knees may be raised.

The tensioning devices 28–42 are strung between the mattress cover 24 and framework 12 so as to pull the mattress cover 24 very tightly like the head of a drum. By placing the tensioning devices 28–42 at a plurality of points and by directing the tensioning devices in various directions the covering 24 is pulled or stretched in all directions across the top of the mattress 20 and thus maintains its smooth shape regardless of the articulated position of the mattress 20.

Figure 5:
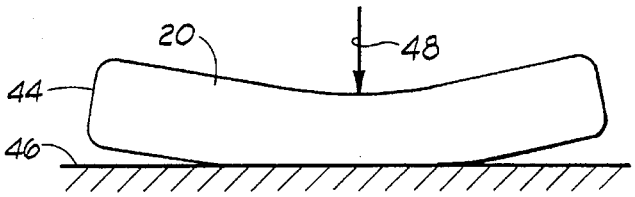
FIG. 5 (PRIOR ART)
FIG. 5 is a laid out illustration of one of the resilient tensioning means utilized in the bed assembly of FIG. 1.

In the embodiment illustrated in FIGS. 1–4, each of the tensioning means 28–42 is made up of two resilient elastomeric members. For example, the tensioning means 30 is shown in laid out form in FIG. 5 and includes a first elastomeric member 58 and a second elastomeric member 60. In a preferred form of the invention the first elastomeric member 58 is a length of surgical tubing having metal hooks 62 and 64 attached to its ends. The second elastomeric member 60 is what is commonly referred to as a bungee cord which is a length of elastic material covered with cloth and having hooks 66 and 68 at its ends.

In use, the first elastomeric member 58 has its hooks 62 and 64 placed through eyelets 70 and 72 which are disposed in a hem which defines the periphery 26 of covering 24. The intermediate portion of the first elastomeric member 58 is stretched down under the structural perimeter framework 16 of bed frame 12 as best seen in FIG. 4. The second elastomeric member or bungee cord 60 has one hook 66 placed about the intermediate portion of first elastomeric member 58 and has its second hook 68 placed over one of the wire members of the bed spring assembly 18 to anchor the tensioning device 20 to the bed spring assembly 18.

It is noted that the hook and eyelet attachment of the tensioning devices to the covering 24 provides a substantially point connection to the covering where the hook such as 62 is placed through the eyelet such as 70.

In viewing FIG. 4 it will be apparent that each of the tensioning means 28 through 42 is constructed and installed in a similar manner with its first elastomeric member connected to two eyelets in the covering 24 and then stretched downward under the structural perimeter framework 16 where it is connected by a bungee cord to the bed spring assembly 18.

When using the plurality of tensioning means 28 through 42 like those illustrated in FIGS. 1–4, the tensioning means 28–42 can be described as a plurality of elongated resilient bands extending back and forth between the covering 24 and the bed frame 12 in a generally zig-zag pattern.

In the zig-zag arrangement such as seen in FIG. 1, alternating ones of the tensioning means such as the two arms of element 58 of tensioning device 30 are oriented to apply tensioning forces at oppositely directed acute angles relative to a vertical line perpendicular to the plane of the top of the inflatable mattress 20. Such acute angles are preferably in the range of from about 30° to 60° from the vertical. One such acute angle is illustrated in FIG. 1 and designated by the numeral 86.

It will be appreciated that there are many other-ways other than eyes and hooks by means of which the resilient members could be attached to the fabric covering 24.

Figure 6:
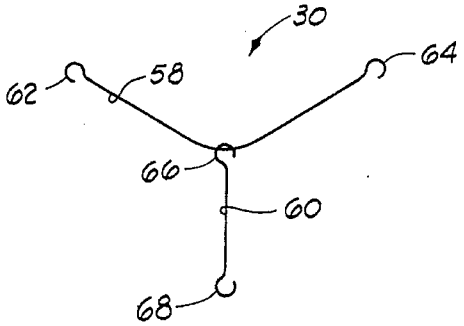
FIG. 6 is a laid out view of an alternative form of resilient tensioning means which may be used in place of that of FIG. 5.

It will be appreciated that the tensioning means 30 could be constructed in many different ways. FIG. 6 illustrates one alternative design for the tensioning means 30 which is designated by the numeral 30A. The tensioning means 30A has a central connector 74 from which three elastic arms 76, 78 and 80 having hooks on their outer ends extend. It will be apparent that the device 30A will function in substantially the same manner as the device 30.

Also, it will be apparent that a resilient tensioning device which functions substantially like the devices 30 and 30A could be constructed without having all three of the arms of the device constructed of elastic or resilient material. One or two of the arms could be constructed from non-elastic material, and the tensioning function can be provided to the device by only one of the arms. At least a portion of each tensioning device should be longitudinally resilient and define a tensioning spring of the member.

Figure 7:
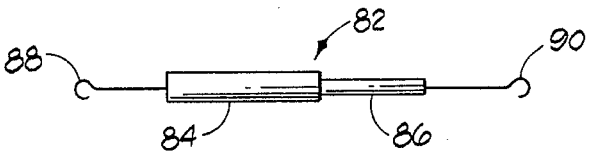
FIG. 7 illustrates a component of still another type of tensioning device which may be substituted for that of FIG. 5.

Also, it is noted that one or more of the elastic arms could be replaced by other types of tensioning devices, such as a hydraulic, pneumatic or electrical tensioning device such as illustrated in FIG. 7 and generally designated by the numeral 82.

If the apparatus 82 is constructed to operate based upon hydraulic or pneumatic principals, it includes a ram 84 having a cylinder 86 extending therefrom which can be extended and retracted with hydraulic or pneumatic power provided from a power source (not shown). Hooks 88 and 90 on opposite ends of the device can either be connected to an arrangement like that shown in FIGS. 5 or 6, or may be connected directly between the covering 24 and the bed frame 12. If the device 82 is an electrical device, then the element 84 may be an electric motor with the element 86 being a rod which may be extended or retracted therefrom through a gear assembly (not shown).

One very significant advantage which is provided by the assembly shown in FIGS. 1–4 having the covering 24 and resilient tensioning means which hold the covering 24 tightly over the inflatable mattress is that the covering 24 and tensioning means hold down the peripheral edges of the mattress as previously noted, so that the edges of the mattress will not bend upward as illustrated in FIG. 8.

Another significant advantage as contrasted to the use of a plain air bed without the covering and resilient tensioning means, is that the covering 24 snugly contains the inflatable mattress 20 between the bed frame 12 and covering 24 so that the inflatable mattress 20 and covering 24 in combination provide a relatively firm and stable supporting surface 84 for the patient at lower inflation pressures than would be required to provide an equally firm and stable supporting surface solely through inflation of the inflatable mattress 20 without the covering 24. This very substantially increases the service life of the inflatable mattress 20.

I have determined that the only manner in which to provide a relatively stable surface on an inflatable mattress 20 if it is not held down with a covering and tensioning device as previously described is to inflate the mattress to relatively high pressures to make it very tight. The disadvantage of that, however, is that when the mattress is inflated to such high pressures, and subsequently when heavy loads are placed upon the mattress, the mattress will have a relatively short service life of perhaps a few days or weeks before a leak forms which renders the mattress unserviceable.

With the assembly of the present invention, on the other hand, I have determined that the mattress 20 can be inflated to much lower pressures, but yet will still provide a very firm supporting surface when the covering 24 and tensioning devices 28–42 are used in combination therewith.

For example, with an eight inch thick inflatable air bed such as the "Deluxe Air Bed" available from Texsport, 1332 Conrad Sauer, Houston, Tex. 77043, the inflatable air mattress can be inflated to relatively low pressures in the range of from about 2 psi to about 4 psi, and then used with the covering and tensioning means to provide a very firm supporting surface. The relatively low inflation pressures, however, in combination with the additional support which is provide to the mattress by the covering and the tensioning means placed thereabout, allow the mattress to have a much longer service life on the order of six months when it is in constant use by a heavy patient.

Although the bed assembly has been illustrated and described for use on an articulated bed which is most often used for long term care patients, it will be appreciated that the same advantages and benefits can be obtained when using the assembly on a standard fixed frame bed. When used with a standard fixed frame bed the inflatable mattress may be placed on top of a box spring or it may be placed on a firm surface such as a board.

EXAMPLE

I developed the bed assembly described above out of personal need while caring for my son who has been an invalid for over five years. After trying all available bed assemblies on the market, and finding it impossible to prevent the occurrence of serious bed sores with them, I began experimenting and developed the bed assembly described above. After trying various prior devices which were available on the market and finding them unsuccessful, I began experimenting with inflatable air mattresses. I first bought a heavy duty inflatable mattress but learned very quickly that an inflatable air mattress alone would not hold up under long term use; they lasted only a few weeks. Also, the inflatable mattress used alone tended to bend upward around the edges when the patient was placed on the mattress. Furthermore, the bed sheets upon which the patient lay could still bunch up and cause irritating points of initiation of bed sores. After I finally arrived at the construction described above utilizing the covering stretched in place over the inflatable air mattress with the plurality of tensioning devices, my son's problem with bed sores began to improve and within about six months the bed sores had all healed. I have continued to use the inflatable mattress assembly with the covering and tensioning devices described above for my son in the privacy of our home for the past four years and he has had substantially no problem with bed sores during that time so long as he uses this mattress assembly. When he does not use the mattress, however, such as during times when he has been hospitalized and used conventional mattresses at the hospital, the bed sores have quickly reoccurred and could not be cured until my son was placed back on my mattress assembly in our home. We are able to achieve a service life of approximately six months with the assembly described above. The assembly is very easily put together when the covering is changed each day. Additionally, it is much easier to care for my son, who is a large man weighing approximately 200 pounds, and particularly it is much easier to roll him over on the bed than was ever the case with any other mattress design we have tried.

Thus it is seen that the apparatus and methods of the present invention readily achieve the ends and advantages mentioned as well as those inherent therein. While certain preferred embodiments of a the invention have been illustrated and described for purposes of the present disclosure, numerous changes may be made by those skilled in the art which changes are encompassed within the scope and spirit of the present invention as defined by the appended claims.

What is claimed is:

1. A bed assembly, comprising:

a bed frame including a structural perimeter framework;

an inflatable mattress having a bottom supported on said bed frame, said mattress having a top and a mattress periphery surrounding said top;

a covering overlying said top of said inflatable mattress, said covering having a covering periphery with a plurality of connecting points throughout said periphery; and a plurality of tensioning means, placed about said covering periphery and connected between said connecting points and said structural perimeter framework, for holding said covering taut and smooth over said top of said inflatable mattress, and for holding down said mattress and preventing said mattress periphery from bending upwardly when a patient lies on said inflatable mattress.

2. The assembly of claim 1, wherein:

said bed frame is an articulated bed frame; and said plurality of tensioning means includes means for holding said covering taut and smooth over said top of said inflatable mattress in multiple articulated positions of said articulated bed frame.

3. The assembly of claim 1, wherein:

said covering snugly contains said inflatable mattress between said bed frame and said covering so that said inflatable mattress and covering, in combination, provide a relatively firm and stable supporting surface for the patient at lower inflation pressure that would be required to provide an equally firm and stable supporting surface solely through inflation of said inflatable mattress without said covering, thereby increasing a service life of said inflatable mattress.

4. The assembly of claim 3, wherein:

said inflatable mattress is inflated to a pressure in a range of from about 2 psi to about 4 psi.

5. The assembly of claim 1, wherein:

said plurality of tensioning means includes a means for tensioning said covering in all directions in the plane of said top of said mattress.

6. The assembly of claim 5, wherein:

said mattress periphery is generally rectangular having four sides and connecting points are disposed along all four sides; and said plurality of tensioning means are placed about all four sides of said mattress periphery.

7. The assembly of claim 1, wherein:

said covering is separable from said inflatable mattress.

8. The assembly of claim 1, wherein:

said covering is integrally attached to said inflatable mattress.

9. The assembly of claim 1 wherein said plurality of tensioning means are resilient tensioning means.

10. The assembly of claim 9 wherein said plurality of resilient tensioning means include a plurality of elongated resilient bands extending back and forth between said connecting points on said covering periphery and said frame in a zig-zag pattern.

11. The assembly of claim 1, wherein said plurality of tensioning means includes a plurality of hydraulically powered tensioning cylinders.

12. The assembly of claim 1, wherein said plurality of tensioning means includes a plurality of electrically powered tensioning elements.

13. The assembly of claim 1, wherein said plurality of tensioning means includes a plurality of pneumatically powered tensioning cylinders.

14. The assembly of claim 1, wherein:

each of said connecting points comprises a hole defined in said covering periphery; and each of said tension means has a hook for engaging one of said holes.

15. The assembly of claim 1, wherein:

said bed frame includes a bed spring assembly stretched across said structural perimeter framework; and said plurality of tensioning means includes a plurality of elongated flexible tensioning members wrapped partially around said structural perimeter framework and anchored to said bed spring assembly.

16. The assembly of claim 15 wherein:

at least a portion of each of said elongated flexible tensioning members is longitudinally resilient and defines a tensioning spring of said member.

17. The assembly of claim 1, wherein said covering is constructed of a non-stretchable breathable fabric.

18. The assembly of claim 1, wherein:

alternating ones of said tensioning means are oriented to apply tension forces at oppositely directed acute angles relative to a line perpendicular to a plane of said top of said inflatable mattress, said acute angle as being in a range of from about 30° to about 60°.

19. The assembly of claim 1, wherein:

said covering is an undersheet adapted and constructed so that a patient may lie directly upon said covering.

20. An articulated bed assembly for use by a long term invalid patient, comprising:

an articulated bed frame;

an inflatable mattress supported on said articulated bed frame;

a covering overlying said inflatable mattress, said covering having a plurality of connecting points along all sides of a periphery thereof; and a plurality of resilient tensioning means placed about said covering and attached between said connecting points and said articulated bed frame, for tensioning said covering in all directions on the plane of said covering and for holding said covering taut and smooth over said inflatable mattress in multiple articulated positions of said articulated bed frame, and for holding down said mattress and preventing said mattress from bending upwardly when a patient lies on said mattress.

21. A mattress assembly for use on a bed frame, comprising:

an inflatable mattress;

a covering means for covering said inflatable mattress, said covering means having a plurality of connecting points around all sides of a periphery thereof; and a plurality of tensioning means, adapted to be connected between said connecting points and said bed frame, for holding and covering taut and smooth over said inflatable mattress, and for holding down said mattress and preventing a periphery of said mattress from bending upwardly when a patient lies on said inflatable mattress.

22. The assembly of claim 21, for use on an articulated bed frame, wherein:

said plurality of tensioning means includes a means for holding said covering taut and smooth over said inflatable mattress in multiple articulated positions of said articulated bed frame.

23. The assembly of claim 22, wherein said covering means and said plurality of tensioning means comprise a means for snugly containing said inflatable mattress between said articulated bed frame and said covering means and for providing a relatively firm and stable supporting surface for the patient at lower inflation pressure than would be required to provide an equally firm and stable supporting surface solely through inflation of said inflatable mattress without said covering means, thereby increasing a service life of said inflatable mattress.

24. The assembly of claim 22, wherein:

said plurality of tensioning means includes a means for tensioning said covering means in all directions in the plane of said covering means.

25. The assembly of claim 24, wherein:

said mattress has four sides; and said plurality of tensioning means are placed about all four sides of said mattress.

26. The assembly of claim 22, wherein:

said plurality of tensioning means are resilient tensioning means.

27. The assembly of claim 26, wherein:

alternating ones of said tensioning means are oriented to apply tension forces at oppositely directed acute angles relative to a line perpendicular to a plane of a top of said inflatable mattress, said acute angles being in a range of from about 30° to about 60°.

28. The assembly of claim 22, wherein:

said covering means is separable from said inflatable mattress.

29. A method of reducing the occurrence of bedsores on long-term bedridden patients, comprising:

(a) providing an articulated bed frame and an inflatable mattress supported on said articulated bed frame;

(b) covering said inflatable mattress with a cover;

(c) applying tension forces between said articulated bed frame and a plurality of connecting points throughout a periphery of said cover and thereby holding said cover taut and smooth over said inflatable mattress in multiple articulated positions of said articulated bed frame; and (d) laying the patient directly on top of said covering.

30. The method of claim 29, wherein:

step (c) includes tensioning said covering in all directions in the plane of said covering.

31. The method of claim 29, wherein:

step (c) includes applying said tension forces at points along all sides of said mattress.

32. The method of claim 29, further comprising:

prior to step (c), inflating said inflatable mattress; and steps (b) and (c) comprise a step of snugly containing said inflatable mattress between said articulated bed frame and said cover and providing a relatively firm and stable supporting surface for the patient at lower inflation pressure than would be required to provide an equally firm and stable supporting surface solely through inflation of said inflatable mattress.

33. The method of claim 32, wherein:

said inflating step includes inflating said inflatable mattress to a pressure in a range of from about 2 psi to about 4 psi.

34. The method of claim 29, further comprising:

holding down a periphery of said mattress relative to said bed frame so that said periphery does not bend upwardly relative to said bed frame when said patient lies on said mattress.

* * * * *

UNITED STATES PATENT AND TRADEMARK OFFICE

CERTIFICATE OF CORRECTION

PATENT NO. : 5,491,854

DATED : February 20, 1996

INVENTOR(S) : Earl D. Music

It is certified that error appears in the above-identified patent and that said Letters Patent is hereby corrected as shown below:

Column 1, line 15, delete "which" and insert --whom-- therefor.

Column 2, line 24, delete "position" and insert --positions-- therefor.

Column 4, line 50, delete "articulate" and insert --articulated-- therefor.

Column 6, line 61, delete "provide" and insert--provided-- therefor.

Column 8, line 32 (Claim 6, line 3), after "and" and before "connecting," insert --said--.

Column 9, line 13 (Claim 18, line 5), delete "angle as" and insert --angles-- therefor.

UNITED STATES PATENT AND TRADEMARK OFFICE

CERTIFICATE OF CORRECTION

PATENT NO. : 5,491,854

DATED : February 20, 1996

INVENTOR(S) : Earl D. Music

It is certified that error appears in the above-indentified patent and that said Letters Patent is hereby corrected as shown below:

Column 9, line 45 (Claim 21, line 9), delete "and," first occurrence, and insert --said--therefor.

Signed and Sealed this

Twentieth Day of August, 1996

*Attest:*

Bruce Lehman

BRUCE LEHMAN

*Attesting Officer*

*Commissioner of Patents and Trademarks*